US007007523B2

(12) United States Patent
Belden, Jr.

(10) Patent No.: US 7,007,523 B2
(45) Date of Patent: Mar. 7, 2006

(54) BOTTLE SECURITY DEVICE

(75) Inventor: Dennis D. Belden, Jr., Waxhaw, NC (US)

(73) Assignee: Alpha Security Products, Inc., Charlotte, NC (US)

( * ) Notice: Subject to any disclaimer, the term of this patent is extended or adjusted under 35 U.S.C. 154(b) by 0 days.

(21) Appl. No.: 11/059,948

(22) Filed: Feb. 17, 2005

(65) Prior Publication Data

US 2005/0144992 A1 Jul. 7, 2005

Related U.S. Application Data

(62) Division of application No. 10/373,234, filed on Feb. 24, 2003.

(51) Int. Cl.
*E05B 65/00* (2006.01)

(52) U.S. Cl. ..... 70/57.1; 206/1.5; 220/210; 220/230; 215/207; 215/216

(58) Field of Classification Search ..... 70/57.1; 206/1.5, 445; 220/210, 230, 750; 215/201, 215/202, 204, 206, 207, 214–217, 221, 250, 215/251, 253, 254, 247, 272, 274, 278
See application file for complete search history.

(56) References Cited

U.S. PATENT DOCUMENTS

| | | | |
|---|---|---|---|
| 445,755 | A | 2/1891 | King |
| 654,533 | A | 7/1900 | Garner |
| 770,387 | A | 9/1904 | Richards |
| 783,885 | A | 2/1905 | MoDougall |
| 809,213 | A | 1/1906 | Osgood |
| 833,446 | A | 10/1906 | Degener |
| 880,723 | A | 3/1908 | Cumming |
| 1,343,962 | A | 6/1920 | Byrne |
| 1,937,295 | A | 11/1933 | Rettenmeyer |
| 2,418,039 | A | 3/1947 | Mays |
| 3,025,990 | A | 3/1962 | Pancrazl |
| 3,804,284 | A | 4/1974 | Moore et al. |
| 3,863,798 | A | 2/1975 | Kurihara et al. |
| 3,893,582 | A | 7/1975 | Kowalik |
| 3,944,102 | A | 3/1976 | Grau |
| 3,947,930 | A | 4/1976 | Martens et al. |
| 4,056,209 | A | 11/1977 | Winkler et al. |
| 4,260,067 | A | 4/1981 | Andruchiw |
| 4,279,353 | A | 7/1981 | Honma |

(Continued)

FOREIGN PATENT DOCUMENTS

| | | |
|---|---|---|
| AR | 203.305 | 8/1975 |

(Continued)

*Primary Examiner*—Suzanne Dino Barrett
(74) *Attorney, Agent, or Firm*—Sand & Sebolt

(57) ABSTRACT

A bottle security device includes an inner member, an outer member and a cap member that cooperate to lock the bottle security device on the neck of a bottle. The inner member includes a plurality of fingers that are adapted to fit under the bead on a bottle neck. The cap member and the outer member are connected to form an enclosure therebetween which houses a locking mechanism. The outer sleeve member of the device slides over the inner member and forces the fingers against the bottle neck. Pins are connected to the inner member and extend into the locking mechanism to lock the inner and outer members together when the inner member is inserted in the outer member. A magnetic key is used to separate the two pieces and release the security device from the bottle. The key attracts a portion of the locking mechanism to disengage the mechanism from the pin.

20 Claims, 15 Drawing Sheets

U.S. PATENT DOCUMENTS

| | | | | |
|---|---|---|---|---|
| 4,570,810 | A | 2/1986 | Hawkins | |
| 4,710,752 | A | 12/1987 | Cordery | |
| 4,775,061 | A | 10/1988 | Coote | |
| 4,796,768 | A | 1/1989 | Stuckey | |
| 4,944,075 | A | 7/1990 | Hogan | |
| 4,984,698 | A | 1/1991 | Stuckey | |
| 5,085,332 | A | 2/1992 | Gettig et al. | |
| 5,269,429 | A | 12/1993 | Schumacher | |
| 5,303,835 | A | 4/1994 | Haber et al. | |
| 5,386,924 | A | 2/1995 | Flinta et al. | |
| 5,431,293 | A | 7/1995 | Piron | |
| 5,464,109 | A | 11/1995 | Greenwald | |
| 5,519,381 | A | 5/1996 | Marsh et al. | |
| 5,586,670 | A | 12/1996 | Greenwald | |
| 5,602,530 | A | 2/1997 | Holmgren | |
| 5,615,788 | A | 4/1997 | Larguia | |
| 5,749,484 | A | 5/1998 | Trout | |
| 5,769,252 | A | 6/1998 | Volpe | |
| 5,957,313 | A | 9/1999 | Bouan | |
| 5,960,972 | A | 10/1999 | Larguia, Sr. | |
| 6,382,416 | B1 | 5/2002 | Gainey | |
| 6,604,643 | B1 | 8/2003 | Michael et al. | |
| 6,631,629 | B1 | 10/2003 | Fuss et al. | |
| 6,912,878 | B1 * | 7/2005 | Belden, Jr. | 70/57.1 |
| 2003/0102279 | A1 | 6/2003 | Michael et al. | |
| 2003/0121879 | A1 * | 7/2003 | Smith et al. | 215/251 |
| 2003/0168456 | A1 * | 9/2003 | Tomasella | 220/257.1 |
| 2004/0016269 | A1 | 1/2004 | Skjellerup | |
| 2004/0060892 | A1 * | 4/2004 | Heston et al. | 215/254 |
| 2004/0182814 | A1 * | 9/2004 | Suffa | 215/216 |

FOREIGN PATENT DOCUMENTS

| | | |
|---|---|---|
| AR | 212.291 | 6/1978 |
| AR | 214.228 | 5/1979 |
| AR | 227.988 | 12/1982 |
| AR | 235.976 | 10/1987 |
| AR | 239.915 | 12/1989 |
| AR | 246.914 | 10/1994 |
| DE | 2121739 | 11/1972 |
| DE | 2307205 | 8/1974 |
| DE | 3211387 | 9/1983 |
| EP | 0385540 | 9/1990 |
| EP | 0522679 | 1/1993 |
| EP | 0687635 | 12/1995 |
| FR | 2586231 | 2/1987 |
| FR | 2608285 | 6/1988 |
| GB | 677311 | 8/1952 |
| GB | 2082552 | 3/1982 |
| WO | WO 89-07076 | 8/1989 |
| WO | WO 91/04201 | 4/1991 |
| WO | WO 92/00173 | 1/1992 |
| WO | WO 92/12067 | 7/1992 |
| WO | WO 94/08867 | 4/1994 |
| WO | WO 97/00819 | 1/1997 |
| WO | WO 99/67149 | 12/1999 |

* cited by examiner

BOTTLE SECURITY DEVICE

CROSS REFERENCE TO RELATED APPLICATIONS

This application is a divisional application of U.S. patent application Ser. No. 10/373,234, filed Feb. 24, 2003; the disclosure of which is incorporated herein by reference.

BACKGROUND OF THE INVENTION

1. Technical Field

This invention relates to article security devices used by retail and similar stores and outlets. More particularly, the invention relates to electronic article surveillance security devices attachable to articles in a manner that makes the devices essentially impossible to remove or disable absent destruction of the devices or using keys that release the devices from the item on which they are secured. Specifically, the present invention is related to a bottle security device that holds an electronic article surveillance component where the bottle security device is configured to be received over the end of a typical bottle such as those bottles used to hold beer, wine, and liquor, in a manner that prevents its removal absent substantial damage to the bottle or bottle security device or the use of a corresponding key.

2. Background Information

The need to prevent, deter, stop, and/or catch shoplifters has become of increased concern to retail store owners. To meet this increasing demand, various forms of electronic article surveillance have been developed. One type of electronic article surveillance includes the use of a detector that is typically disposed about the exit and entrance to the retail establishment. The system then utilizes electronic article surveillance (hereinafter EAS) tags that are attached to items in the retail store. An alarm may be activated when an EAS tag is passed in close proximity to the detector. Thus, if a shoplifter attempts to take an article having an EAS tag through the exit, an alarm sounds and the management of the store is immediately notified.

One drawback to such a system is that an EAS tag must be placed on each article in the store to protect the article from theft. Although such systems are manageable for stores that sell articles such as videocassettes, compact discs, audio cassettes, and other boxed materials where an EAS tag can be hidden in a place where it cannot be removed, such systems are impracticable for retail stores that sell items having packaging that does not provide a readily available space for hiding or securing an EAS tag. Although locking straps have been developed that wrap about a portion of an article to secure an EAS tag to the article, such EAS tag-carrying straps may be defeated when the article being protected may be easily transferred to another container. Such is the case when the article being protected is wine or liquor.

A retail store selling wine or liquor cannot easily attach an EAS tag to the liquor bottles in a location where it cannot be easily removed by a shoplifter. Further, if an EAS tag-carrying locking strap is utilized, the shoplifter may still open the bottle of liquor and pour the contents into an untagged container and then leave the store. It is thus desired in the art to provide a device that carries an EAS component that may be utilized to prevent the unauthorized opening of a typical wine or liquor bottle. For such a device to be commercially successful, the device must fit a variety of differently sized bottles while being openable with a common key held by the check-out clerk in the retail store. Such devices must also be able to withstand twisting, prying, and shock forces applied to the device by a shoplifter in order to dislodge the device from a bottle.

One example of an anti-theft device for bottles is disclosed in U.S. Pat. No. 5,602,530. The device disclosed in this patent includes an outer socket which can be moved in relation to an inner socket between two end positions with one of the end positions being a locking position. A plurality of retainers are distributed about the periphery of the inner surface of the outer socket. The retainers extend into the inner socket when the outer socket is in the locked end position. These retainers engage the bottle beneath the bead that is typically disposed on the neck of a bottle. The retainers thus prevent the removal of the device from the neck of the bottle until biased outwardly by a magnetic key. Although devices such as this function for their intended purpose, room for improvement remains in the art.

Another example of an anti-theft device for bottles is disclosed in International Publication No. WO99/67149 published on Dec. 29, 1999. This publication discloses a device having an inner member and an outer member in which a locking mechanism comprises teeth extending outwardly from the inner member which lockably engage teeth extending inwardly from arms which extend upwardly from the lower portion of and on the interior of the outer member. The locking mechanism thus lies between respective side walls of the inner and outer members.

BRIEF SUMMARY OF THE INVENTION

The present invention provides a bottle security device having an outer member and an inner member which slide over and lock on the neck of a bottle via locking fingers which are cammed inwardly around the neck when the inner member is pushed into the outer member, the device including a locking mechanism to selectively lock the inner member within the outer member to hold the locking fingers in a locked position around the bottle neck, and a key for unlocking the locking mechanism.

The present invention also provides a bottle security device for use with a bottle having a neck, the bottle security device comprising an inner member adapted to fit around at least a portion of the neck of the bottle; an outer member having a cavity, the inner member selectively lockable in the cavity; the outer member having an end wall; and a locking mechanism disposed above the inner member and below the end wall of the upper member; and preferably, no portion of the locking mechanism is disposed between respective side walls of the inner member and the outer member.

The invention further provides a bottle security device capable of holding an electronic article surveillance (EAS) tag disposed in the space between the inner and outer members or on the inner surface of the end wall of the inner member.

The invention provides an embodiment that includes a cap member connected to the upper end of the outer member to form an enclosure therebetween, in which are located the EAS tag and the locking mechanism, which is preferably a clutch assembly that locks onto a pin connected to the inner member.

These and other objectives and advantages of the present invention are obtained by the improved bottle security device of the present invention, the general nature of which includes an inner member adapted to fit around at least a portion of the neck of a bottle; an outer member defining a cavity; a portion of the inner member disposed in the cavity and moveable between locked and unlocked positions; a cap member connected to the outer member to define an enclosure between the cap member and the outer member; at least one pin connected to the inner member; and a locking mechanism adapted to lockably receive the at least one pin; the locking mechanism at least partially disposed in the enclosure.

BRIEF DESCRIPTION OF THE SEVERAL VIEWS OF THE DRAWINGS

Preferred embodiments of the invention, illustrative of the best mode in which the applicants have contemplated applying the principles of the invention, are set forth in the following description and are shown in the drawings and are particularly and distinctly pointed out and set forth in the appended claims.

Similar numerals refer to similar parts throughout the specification.

DETAILED DESCRIPTION OF THE INVENTION

Figure 1:
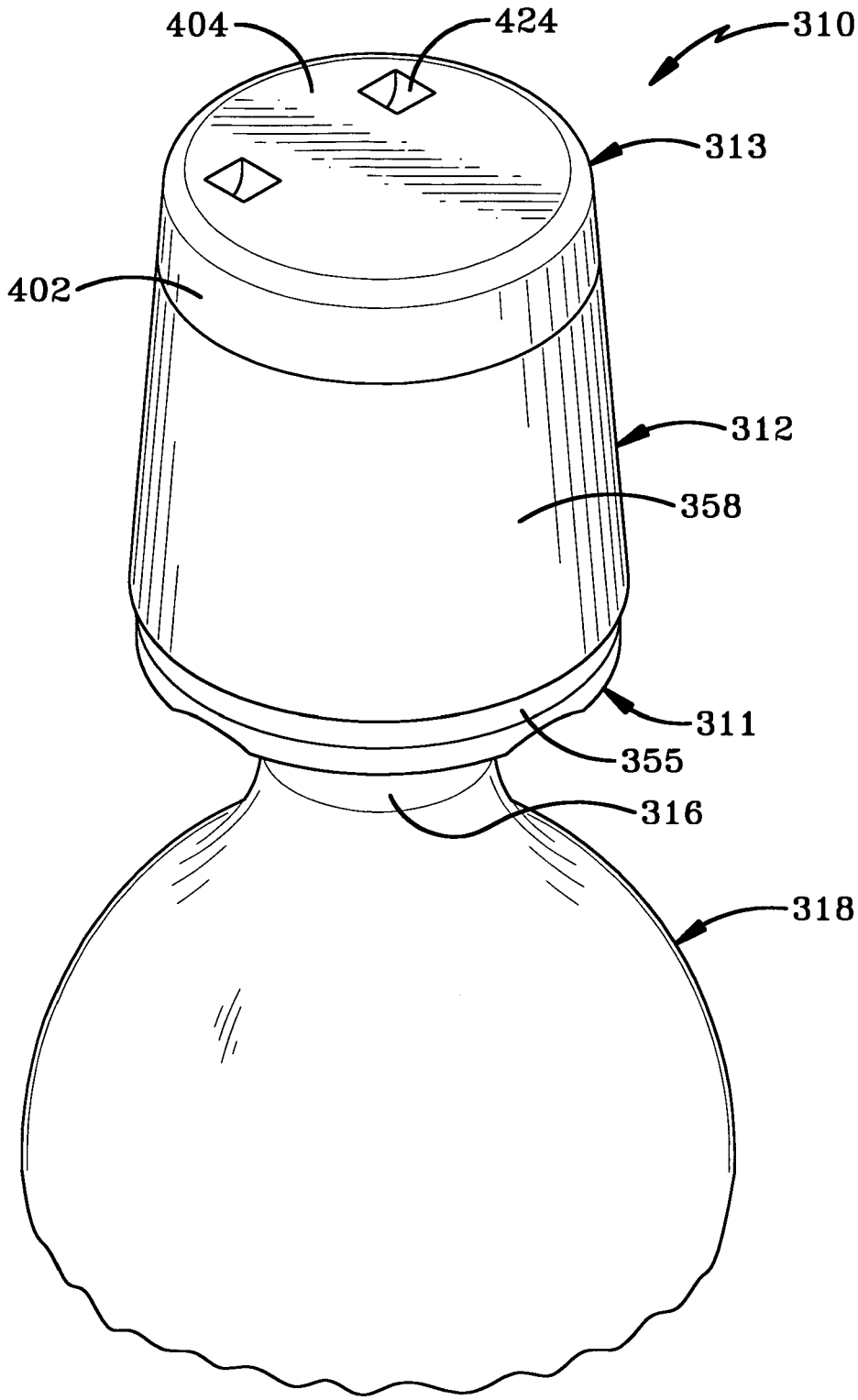
FIG. 1 is a perspective view of the bottle security device of the present invention in a locked position on a bottle.
Figure 2:
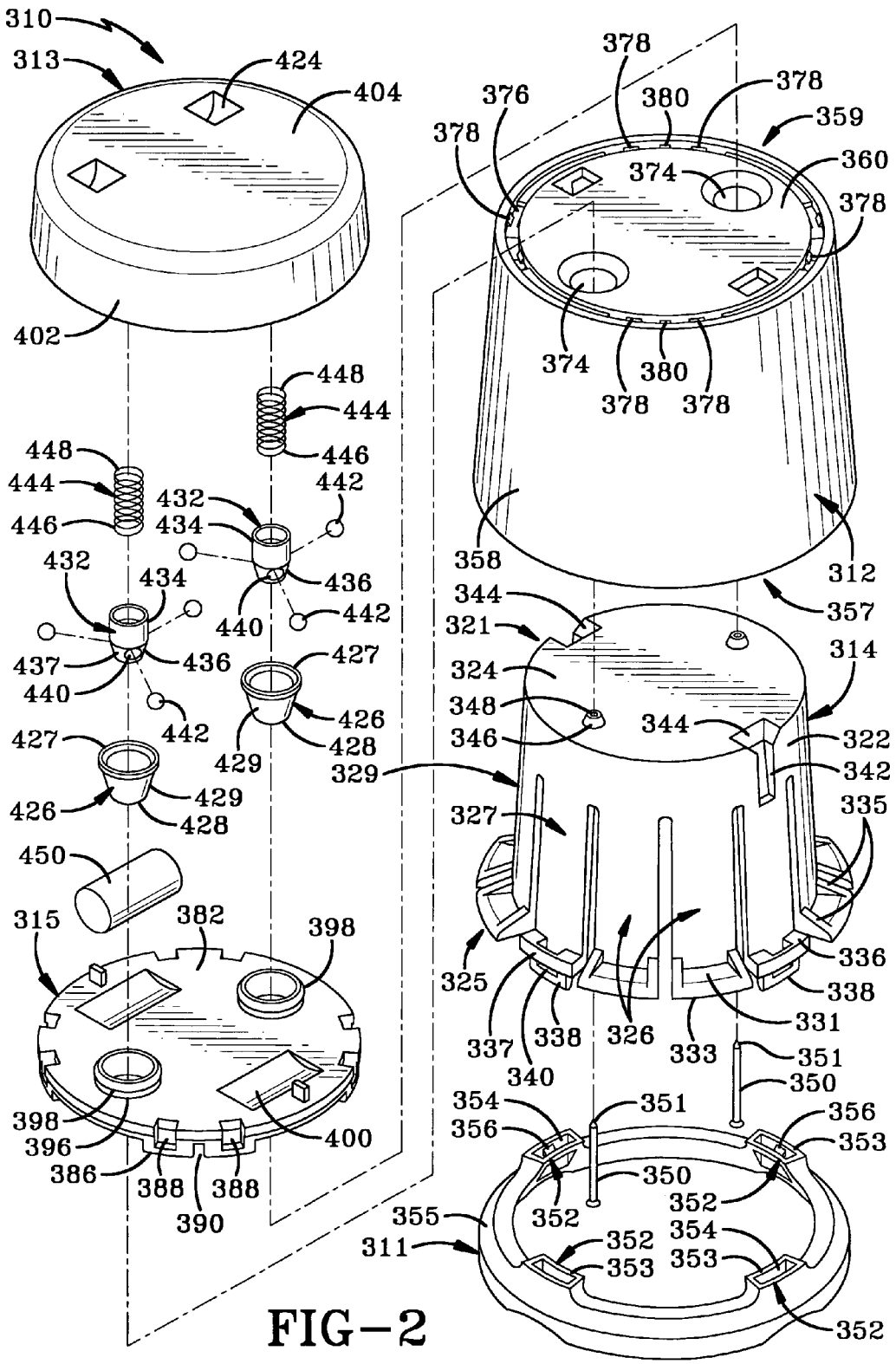
FIG. 2 is an exploded view of the bottle security device of FIG. 1.
Figure 3:
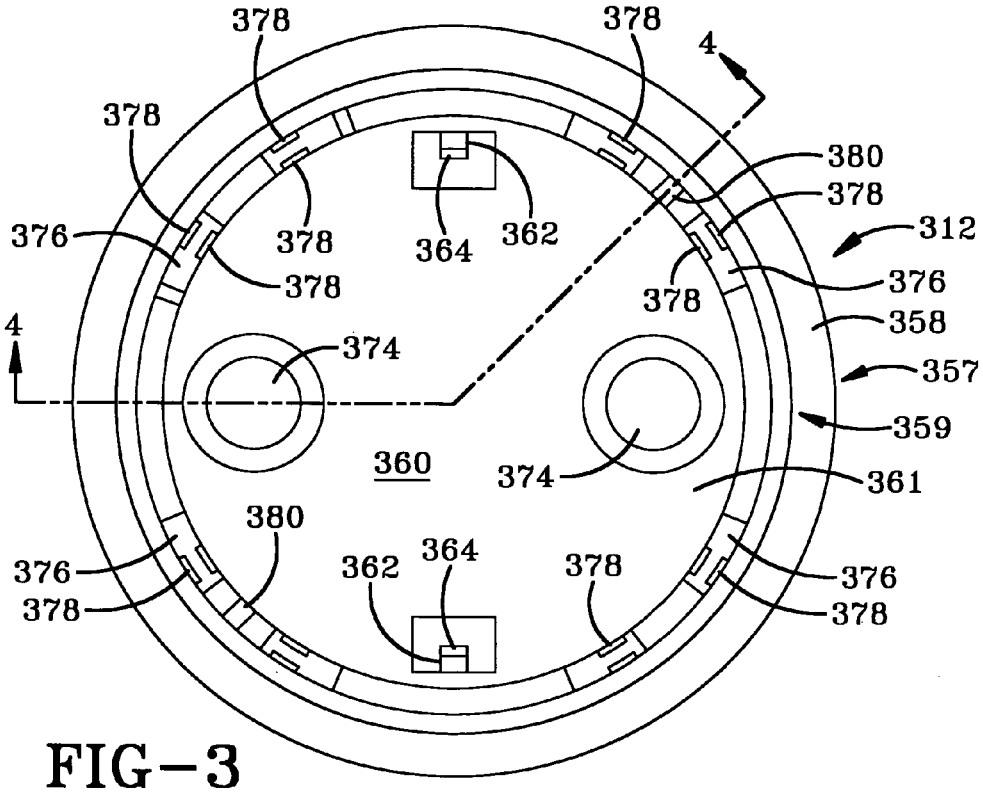
FIG. 3 is a top plan view of the outer member of the security device of FIG. 2.

A bottle security device according to the concepts of the present invention is depicted in FIGS. 1–18 and is indicated generally by the numeral 310. Bottle security device 310 generally includes an outer sleeve member 312, an inner sleeve member 314 and a locking mechanism that cooperate to lock device 310 on the neck 316 of a typical bottle 318. The locking mechanism is positioned above the top of the bottle and may be disposed intermediate the top of inner sleeve member 314 and top of outer sleeve member 312. Preferably, no portion of the locking mechanism is disposed between respective side walls 329 and 358 of inner member 314 and outer member 312. This configuration allows for a slimmer design of device 310 and is also easier to mold. In the exemplary embodiment, outer sleeve member 312 includes an upper cap member 311. Also in the exemplary embodiment, the locking mechanism includes pins 350 which are respectively engaged by a clutch assembly locking mechanism. Device 310 may also include a lower ring member 311 and an intermediate plate member 315. Bottle security device 310 may be locked on bottle neck 316 until unlocked with a key 317 (FIGS. 17–18), such as a magnetic key.

Figure 11:
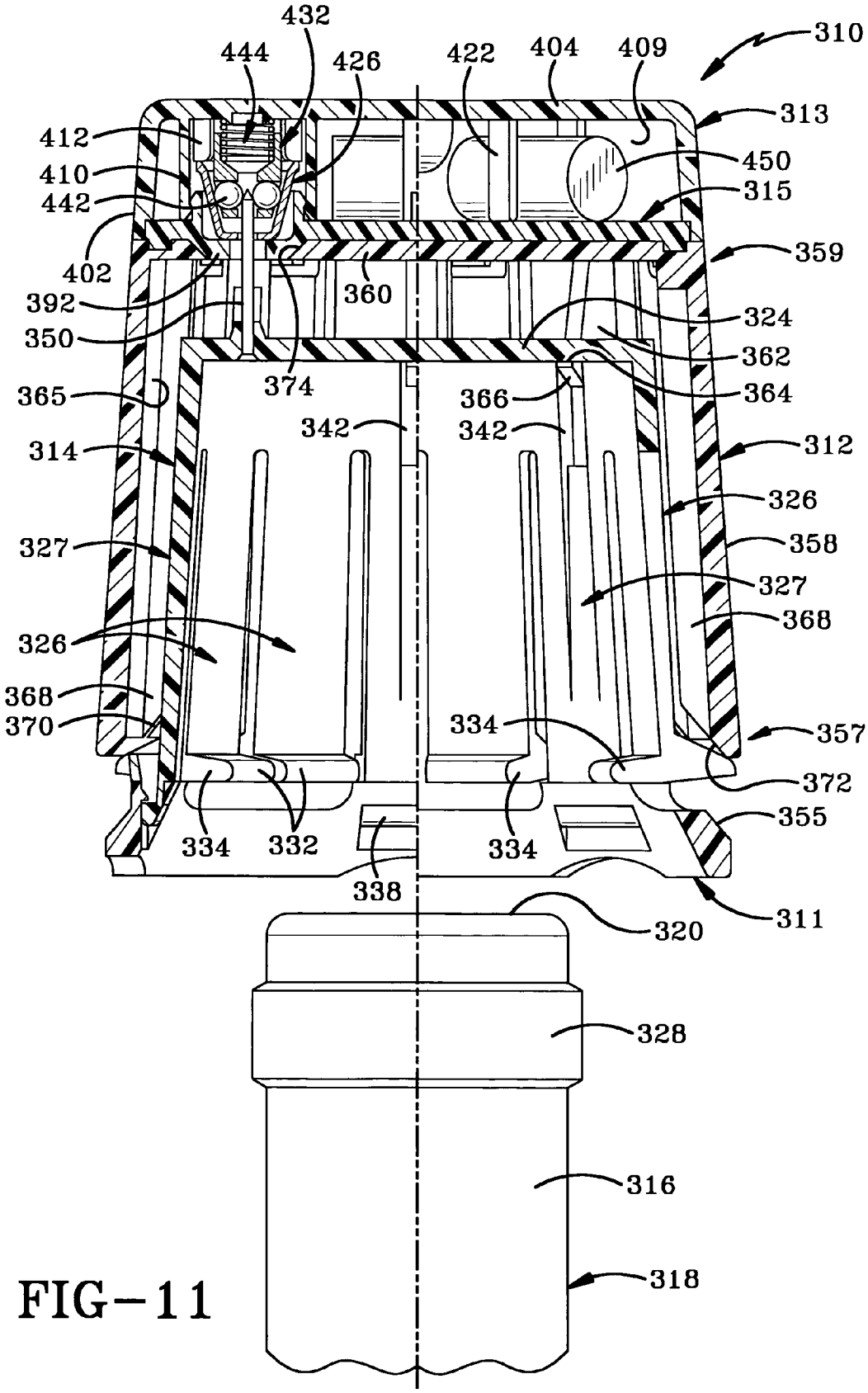
FIG. 11 is a sectional view of the bottle security device of the present invention in an unlocked position situated adjacent the neck of a bottle prior to inserting the neck into the device.
Figure 12:
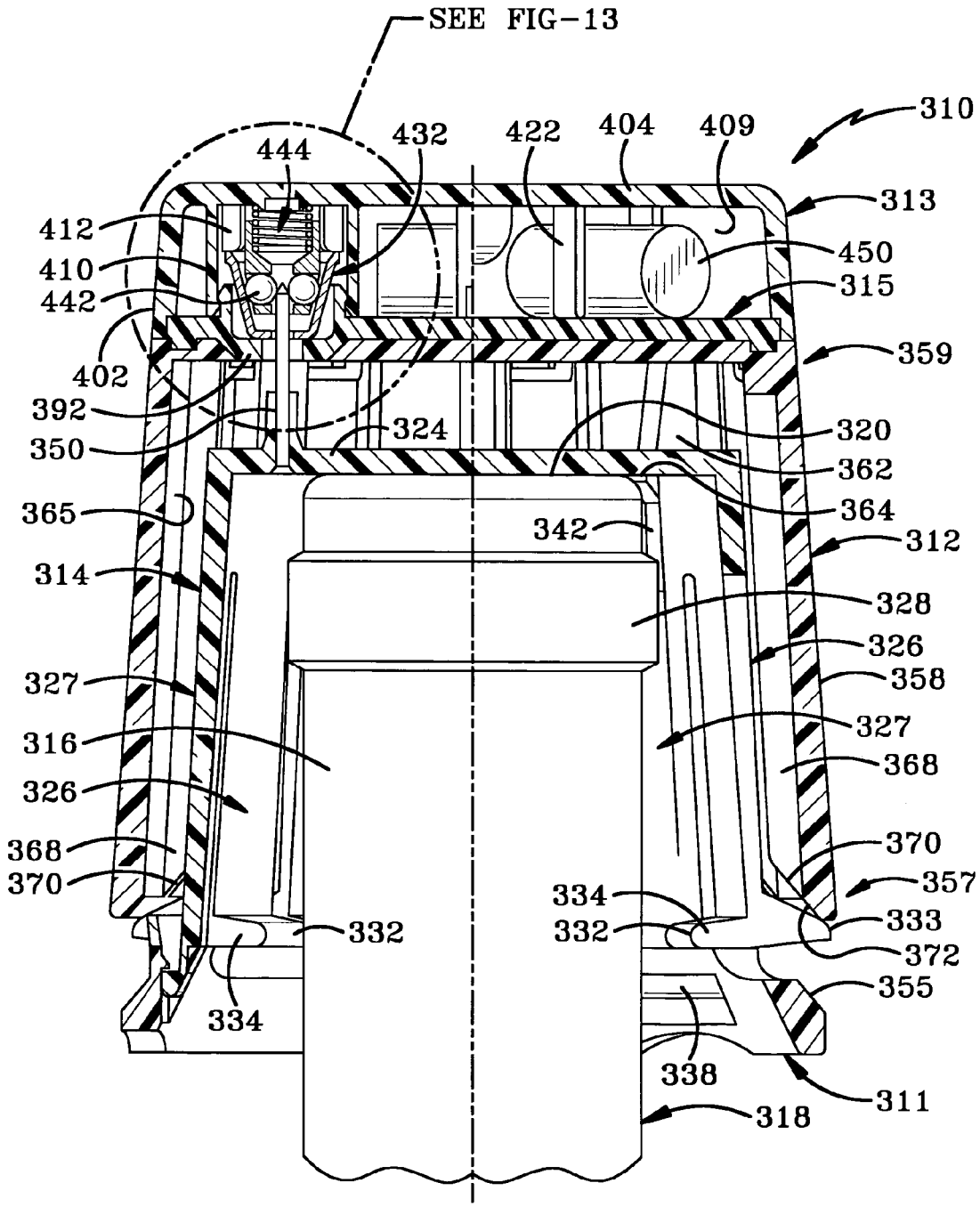
FIG. 12 is a sectional view of the bottle security device of the present invention in an unlocked position with the neck of a bottle inserted in the inner member of the device.
Figure 13:
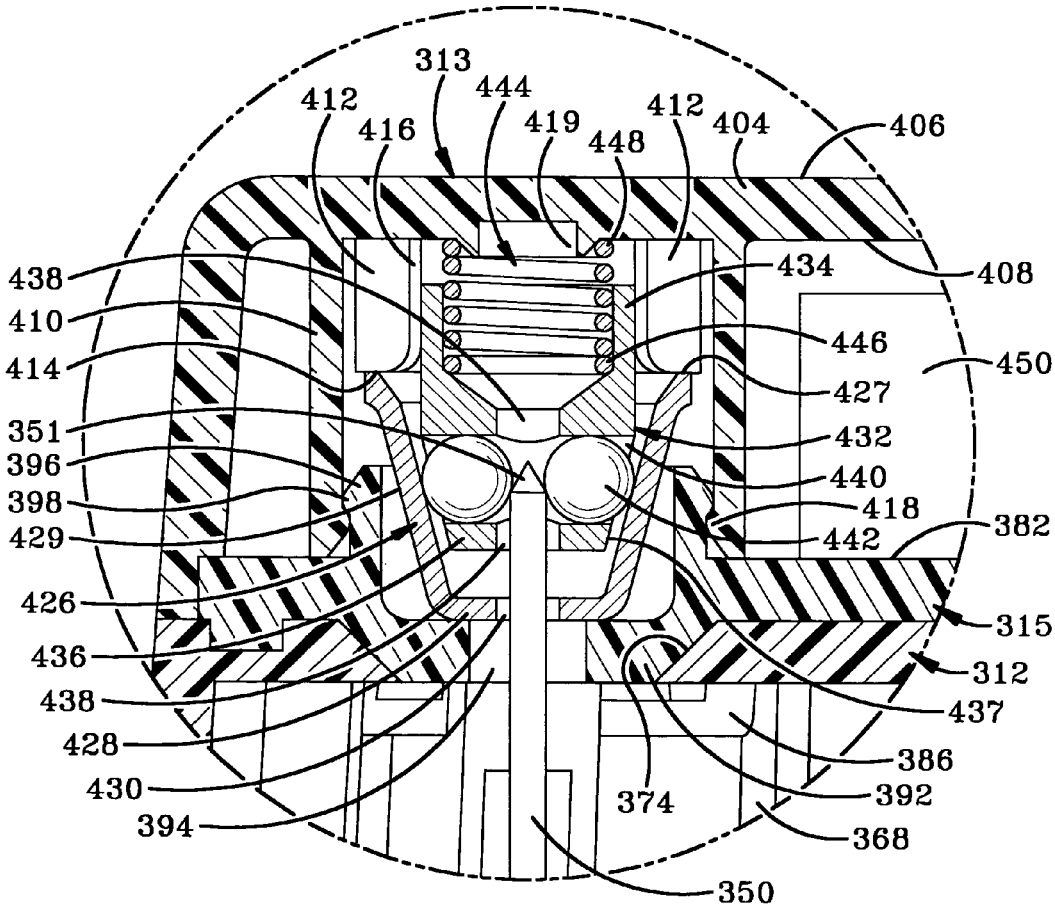
FIG. 13 is an enlarged view of the encircled portion of FIG. 12.

Inner sleeve member 314 (FIGS. 2, 5, 6) has an upper end 321, a lower end 325, a central axis 323 (FIG. 6) and a substantially cylindrical or frustoconical side wall 329. Side wall 329 includes a body 322 substantially closed at upper end 321 by a substantially circular end wall 324. A plurality of locking fingers 326 are cantilevered from body 322 and extend downwardly therefrom toward lower end 325. Locking fingers 326 are configured to fit over the bead 328 typically disposed on bottle neck 316 (FIG. 11). Locking fingers 326 may be sized to engage bead 328 and be forced radially outwardly when inner sleeve member 314 is forced over bead 328. To facilitate such movement, each finger 326 is provided with an angled or arcuate surface 330 configured to engage the upper surface of bead 328 when inner sleeve member 314 is forced over bead 328. Locking fingers 326 are further configured to be resilient so that they return to their resting position after being forced over bead 328. In such a resting position, as depicted in FIG. 12, inner surfaces 332 of locking fingers 326 may or may not contact bottle neck 316 depending on its size. Each locking finger 326 further includes an outwardly extending foot 331 adjacent lower end 325, each foot 331 having an outer surface 333 and a pair of spaced braces 335 angling inwardly and upwardly from outer surface 333. Each locking finger 326 further includes an inwardly extending shoulder 334 adjacent lower end 325. Each shoulder 334 is disposed below bead 328 once inner sleeve member 314 is placed on bottle neck 316.

Inner sleeve member 314 also includes a plurality of connecting fingers 327, which like locking fingers 326 are cantilevered from body 322 and extend downwardly therefrom toward lower end 325. Connecting fingers 327 alternate with locking fingers 326, the preferred embodiment having one connecting finger 327 alternating with two locking fingers 326. Each connecting finger 327 includes a ledge 336 extending outwardly therefrom in a direction away from central axis 323 of inner sleeve member 314. Each ledge 336 includes an outer band 337. Each connecting finger 327 also includes a spur 338 extending downwardly therefrom and defining a hollow space 340 which extends upwardly through ledge 336. Outer band 337 forms the outer boundary of the portion of hollow space 340 which extends through ledge 336. Spur 338 and hollow space 340 aid in connecting inner sleeve member 314 to lower ring member 311 by a snap-fit engagement as further described below.

Inner sleeve member 314 further defines a pair of opposed slots 342 in body 322. Slots 342 extend parallel to fingers 326 and 327 above a respective pair of connecting fingers 327. A beveled entrance 344 to each slot 342 is defined by end wall 324. Entrances 344 and slots 342 aid in the connection of inner sleeve member 314 to outer sleeve member 312 by a snap-fit engagement as further described below.

Inner sleeve member 314 also includes a pair of cones 346 each of which defines a pinhole 348 which extends through end wall 324. Pinholes 348 receive and house pins 350 so that pins 350 are pointed upwardly to extend through outer sleeve member 312 and intermediate plate member 315 into the clutch assembly as further described below. Pins 350 are connected to inner member 314 and have a tapered end 351 to facilitate their reception by the clutch assembly.

Lower ring member 311 (FIG. 2) is annular and configured to connect to lower end 325 of inner member 314 below locking fingers 326 so as to surround a portion of bottle neck 316 when device 310 is installed thereon. Ring member 311 includes a plurality of upwardly extending receptacles 352 each having an upper surface 353 and defining a hollow area 354. Ring member 311 further includes an angled surface 355. Each receptacle 352 further includes a tab 356 extending inwardly into hollow area 354. In connecting inner sleeve member 314 to lower ring member 311, each hollow space 340 in spur 338 of inner sleeve member 314 receives a respective tab 356 when spurs 338 are inserted in respective receptacles 352 of lower ring member 311. Tabs 356 engage respective spurs 338 in a snap-fit engagement to lock members 311 and 314 together. Ledge 336, particularly outer band 337 thereof, inhibits removal of ring member 311 from inner sleeve member 314 as ledge 336 meets flush with upper surface 353 of receptacle 352. It will be appreciated that ring member 311 may be connected to inner member 314 by a variety of ways known in the art. Angled surface 355 facilitates ring member 311 in abutting with outer member 312 to help prevent tampering, as further described below. When connected with inner sleeve member 314, lower ring member 311 provides additional stability and rigidity thereto, helps prevent tampering, and allows locking bottle security device 310 to a bottle without the top of bottle neck 316 engaging end wall 324 of inner sleeve member 314. The latter is accomplished by pushing on ring member 311 to move inner member 314 into outer member 312, as described further below.

Figure 4:
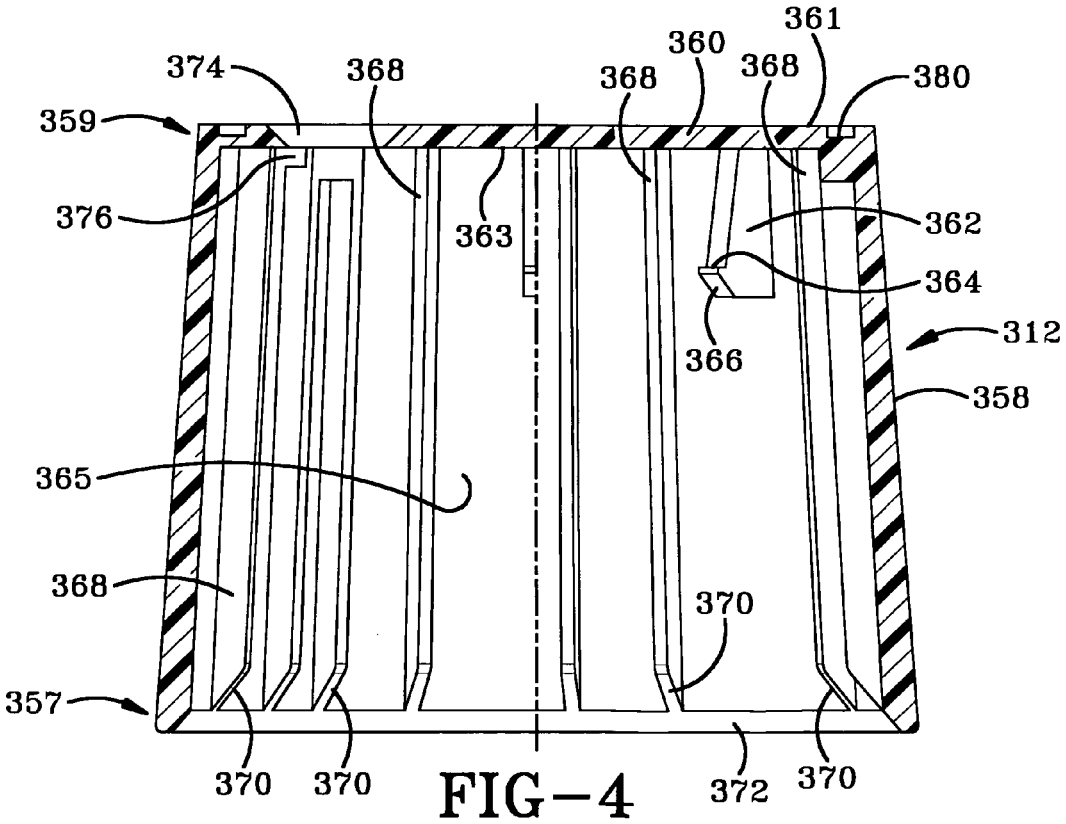
FIG. 4 is a sectional view taken along line 4—4 of FIG. 3.
Figure 5:
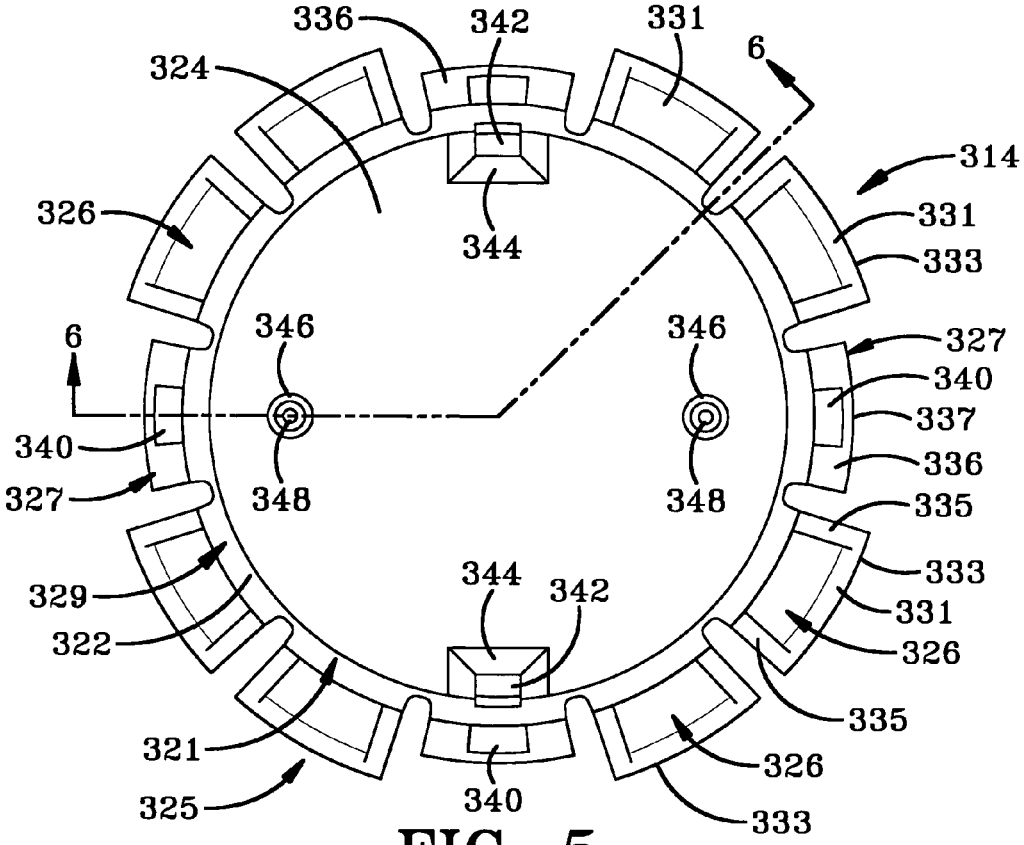
FIG. 5 is a top plan view of the inner member of the security device of FIG. 2.
Figure 6:
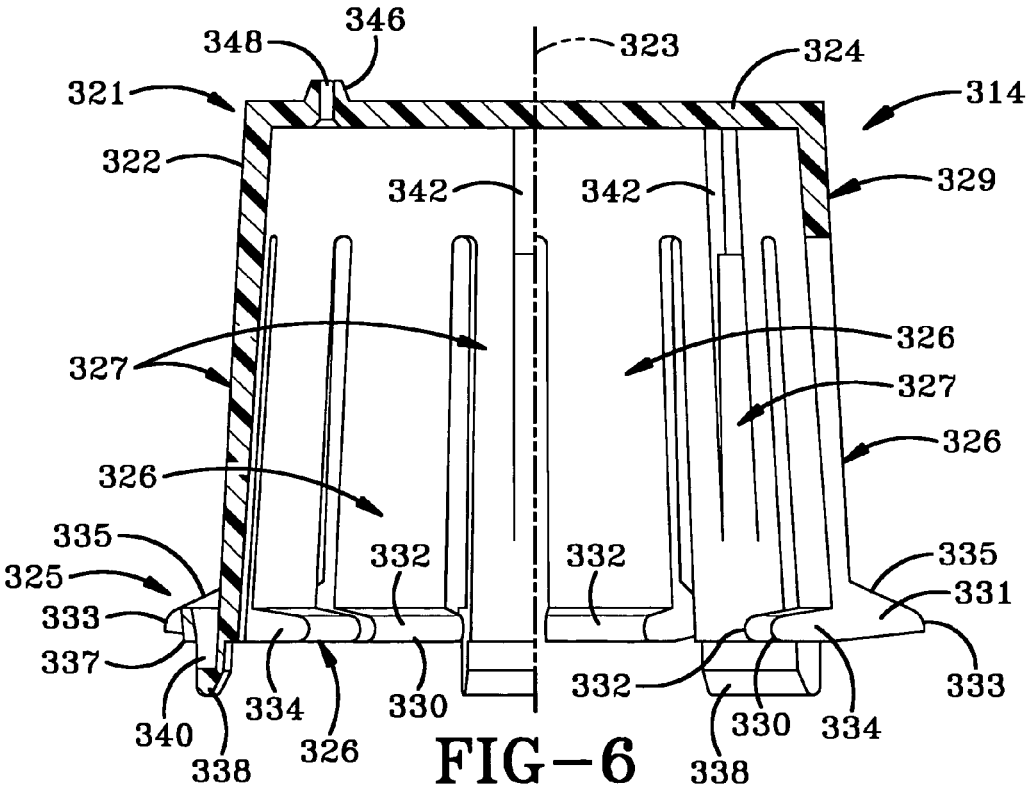
FIG. 6 is a sectional view taken along line 6—6 of FIG. 5.

Outer sleeve member 312 (FIGS. 2–4) defines a cavity 365 (FIG. 4) and is generally configured to fit over inner sleeve member 314 and substantially enclose inner member 314 in cavity 365 such that inner member 314 may not be readily viewed or accessed from outside bottle security device 310. Outer member 312 has a lower end 357 and an upper end 359 and includes a substantially cylindrical or frustoconical sidewall 358 bounded at upper end 359 by a substantially circular end wall 360. End wall 360 has an upper surface 361 and a lower surface 363 (FIG. 4).

Latches 362 (FIG. 4) extend inwardly from sidewall 358 and downwardly from end wall 360 and include hooks 364 extending inwardly from the lower end of latches 362. Each latch 362 includes an angled surface 366 which angles upwardly and inwardly from the lower end of latch 362 toward hook 364, with which surface 366 communicates. In sliding outer member 312 over inner member 314 to connect the two by a snap-fit engagement, angled surfaces 366 engage and slide over beveled entrances 344 to assist hooks 364 in moving into slots 342 so that hooks 364 engage the lower surface of end wall 324. Latches 362 and slots 342 are aligned to align circular holes 374 in outer sleeve member 312 with pinholes 348 in inner sleeve member 314.

Splines 368 (FIG. 4) extend inwardly from side wall 358 and downwardly from end wall 360 substantially the length of outer sleeve member 312. Splines 368 have lower angled edges 370 which taper inwardly and upwardly from adjacent lower end 357. Side wall 358 has tapered surfaces 372 which also taper inwardly and upwardly from lower end 357. Lower angled edges 370 continue from and along the same angle as tapered surfaces 372. In locking security device 310, edges 370 and surfaces 372 engage and slide along feet 331 adjacent outer surface 333 as inner member 314 is moved into outer member 312, as further described below. In the locked position (FIG. 16), tapered surfaces 372 of outer member 312 lie adjacent or may abut ring member 311 along angled surface 355 to block access to inner member 314 to help prevent tampering with device 310.

End wall 360 defines circular holes 374 which taper inwardly and downwardly through end wall 360. End wall 360 further defines a plurality of connecting slots 376 adjacent side wall 358. Opposed tabs 378 extend into slots 376 respectively from side wall 358 and end wall 360. Within a pair of slots 376, respective alignment ridges 380 extend between side wall 358 and end wall 360. Tabs 378 assist in connecting outer sleeve member 312 to intermediate plate member 315 by a snap-fit engagement as further described below. Ridges 380 facilitate alignment between outer member 312 and plate member 315 as further described below.

Figure 9:
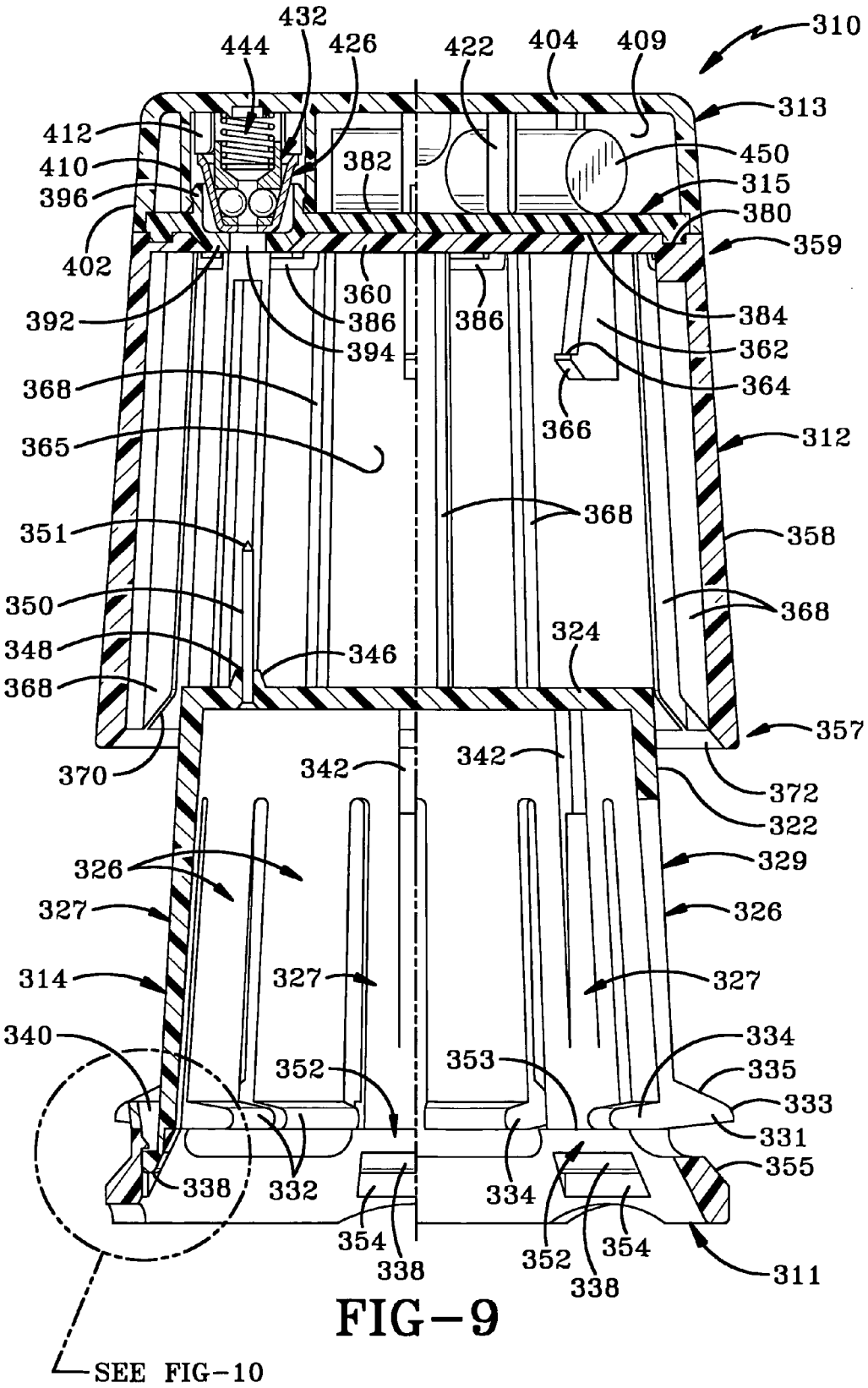
FIG. 9 is a partially exploded sectional view of the bottle security device of FIG. 2.
Figure 10:
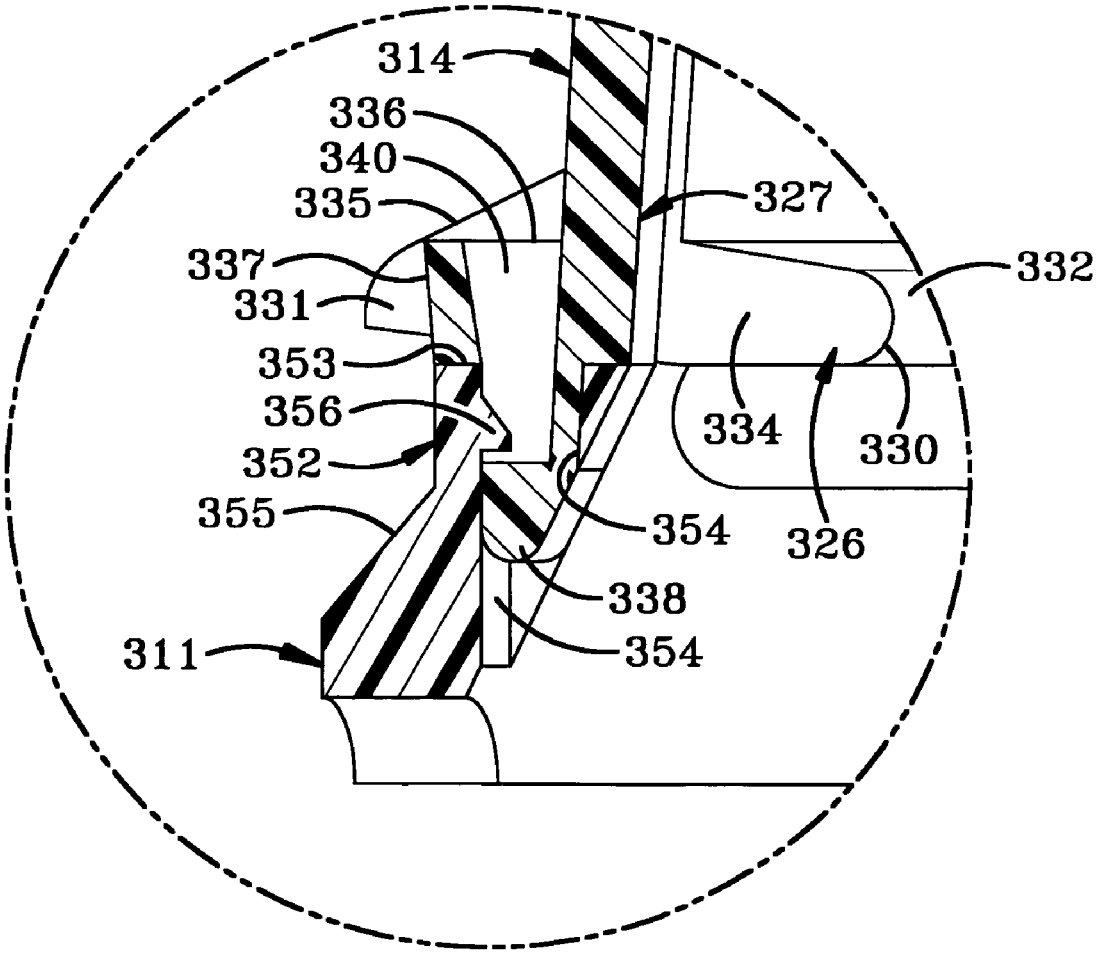
FIG. 10 is an enlarged view of the encircled portion of FIG. 9.

Intermediate plate member 315 (FIG. 2) is a generally flat circular plate having a top surface 382 and bottom surface 384 (FIG. 9). A plurality of inserts 386 extend downwardly adjacent the perimeter of plate member 315 and define holes 388 which receive tabs 378 of outer sleeve member 312 to connect outer member 312 to plate member 315. A pair of inserts 386 each include an alignment notch 390 extending upwardly therein. A pair of frustoconical rings 392 (FIG. 9) extend downwardly from plate member 315 and define respective holes 394 centered within each ring 392 which extend through member 315. Alignment notches 390 align with ridges 380 of outer sleeve member 312 for the purpose of aligning holes 374 of outer member 312 with holes 394 of member 315. A pair of cylinders 396 extend upwardly from plate member 315 and concentrically surround holes 394. A plurality of arcuate ribs (not shown) line the inside of cylinders 396 and are connected to top surface 382 of plate member 315. Each cylinder 396 includes an outwardly extending lip 398 at the upper end thereof. Plate member 315 further defines a pair of generally rectangular and arcuate shallow indentations 400 extending downwardly from top surface 382.

Figure 7:
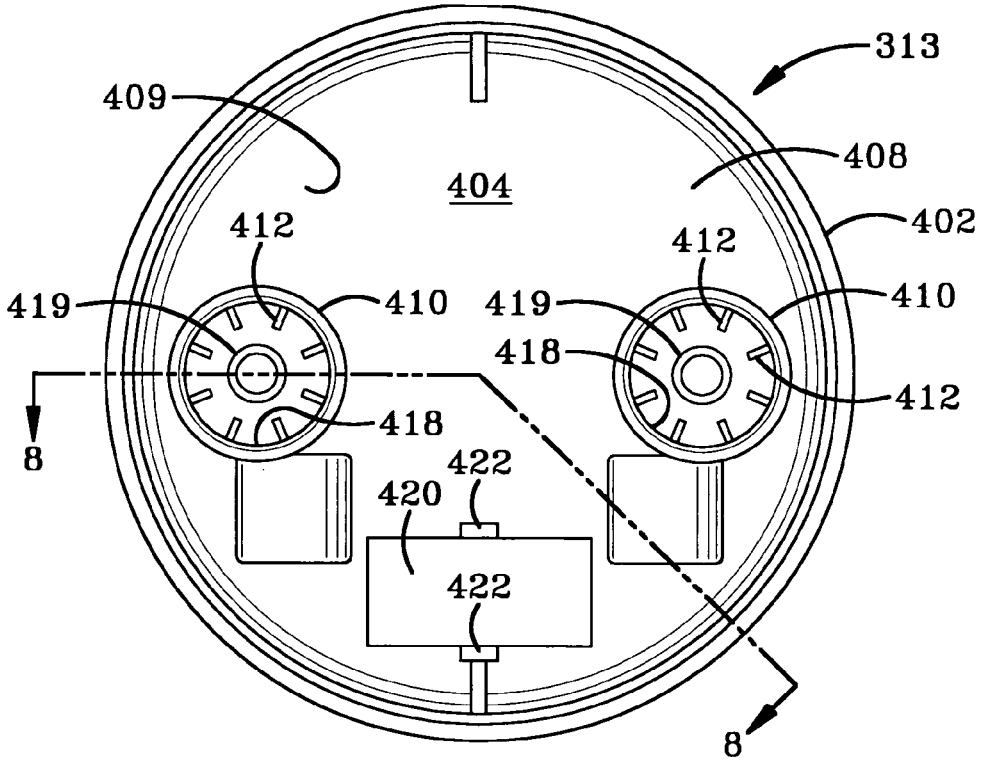
FIG. 7 is a top plan view of the cap member of the security device of FIG. 2.
Figure 8:
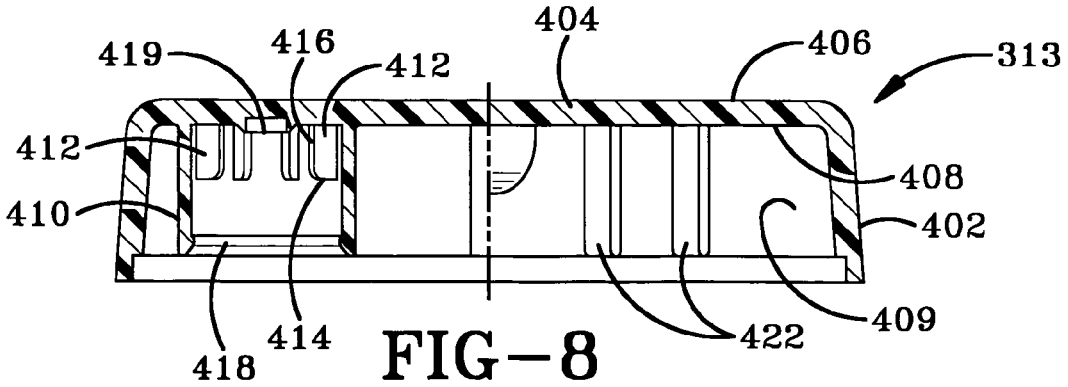
FIG. 8 a sectional view taken along line 8—8 of FIG. 7.

Upper cap member 313 (FIGS. 2, 7, 8) includes a substantially cylindrical or frustoconical annular side wall 402 and substantially circular end wall 404 having an upper surface 406 and a lower surface 408 (FIG. 7, 8). Cap member 313 is connected to plate member 315 to form an enclosure 409 therebetween. Cap member 313 is also connected to outer member 312. Alternately, cap member 313 may be connected to outer member 312 with plate member 315 disposed therebetween and held in place but not connected to either. The connection between cap member 313 and outer member 312 may be achieved by snap-fit engagement, glue, sonic welding or in a variety of other ways known in the art to ensure that a shoplifter will not be able to remove cap member 313 from outer member 312. A pair of cylinders 410 extend downwardly from lower surface 408 of end wall 404 and are aligned with plate member cylinders 396 and configured to slide over and connect with plate member cylinders 396 (FIG. 9). Cylinder 410 includes an inwardly extending lip 418 for forming a snap-fit engagement with the inwardly extending lips 398 of plate member cylinders 396. A plurality of ribs 412 (FIGS. 7, 8) extend radially inward from each cylinder 410 and downward from lower surface 408. Ribs 412 extend partially across cylinder 410 and partially down the length of cylinder 410. Each rib 412 includes a substantially flat lower surface 414 substantially parallel to end wall 404 and a substantially flat inner surface 416 substantially parallel to the walls of cylinder 410. Centered within each cylinder 410 is inner ring 419, which extends downwardly from lower surface 408. Cap member 313 defines a shallow rectangular indentation 420 extending upwardly from lower surface 408 of end wall 404, said indentation 420 being bounded on its long sides by respective retaining fingers 422 extending downward from lower surface 408 of end wall 404. Cap member 313 defines a pair of keyholes 424 (FIG. 2) which extend downwardly from upper surface 406 of cap member 313, but not all the way through cap member 313. Keyholes 424 are configured to properly align a magnet in magnetic key 317 with the locking mechanism to unlock the mechanism of security device 310 as further described below.

It will appreciated that device 310 may be formed without plate member 315 without departing from the spirit of the invention. Cap member 313 may be directly connected to outer member 312 to form an enclosure therebetween. Plate member 315 is included to simplify the molding process where outer member 312 and plate member 315 are made of plastic. Device 310 may also function without ring member 311, although ring member 311 provides an additional degree of protection from shoplifters tampering with device 310. Ring member 311 may be formed with inner member 314, but is formed separately due to the molding process where members 314 and 311 are made of plastic.

Security device 310 further includes a clutch assembly locking mechanism housed within enclosure 409. More particularly, device 310 includes a pair of hollow frustoconical bells 426 (FIGS. 2, 13) each having an open larger end 427, a sidewall 429 and an end wall 428 (FIG. 13) defining a hole 430, said bells 426 configured to be received within respective plate member cylinders 396 with end wall 428 enclosed therein. Each end 427 of bells 426 abuts or lies closely adjacent lower surface 414 of ribs 412 in cylinders 410 of cap member 313. Device 310 also includes a pair of races 432 (FIG. 2, 13) having a hollow cylindrical upper portion 434 and a lower frustoconical lower portion 436 which tapers inwardly and downwardly from upper portion 434. Each lower portion 436 has an outer surface 437 and defines a central hole 438 (FIG. 13 ) extending downwardly from upper portion 434. Each lower portion 436 also defines three channels 440 extending radially inward from outer surface 437, said channels 440 communicating with one another and with hole 438. Each channel 440 is configured to receive a ball bearing 442. Each race 432 is configured to be received along with ball bearings 442 in channels 440 by respective bells 426 so that each lower portion 436 is substantially encompassed by a respective bell 426. Device 310 further includes a pair of springs 444 each having a lower end 446 configured to be received within respective hollow upper portions 434 of races 432. Each spring 444 has an upper end 448 configured to be received within the area encircled by ribs 412 in cap member cylinders 410. Upper ends 448 are configured to be centered around inner ring 419. The clutch assembly is configured to receive pins 350, which extend from and through end wall 324 of inner member 314 via pinholes 348 in cones 346 and further through holes 374 in outer member 312 and holes 338 in intermediate plate member 315 into the clutch assembly, which locks pins 350 in place to prevent the outward movement of inner member 314 from within outer member 312. Alternate locking mechanisms configured to lock pins 350 in place may be used without departing from the spirit of the invention. Device 310 further includes a cylindrical electronic article surveillance (EAS) tag 450 configured to be disposed between an indentation 440 in plate member 315, indentation 420 in cap member 313 and retaining fingers 422 of cap member 313.

Lower ring member 311, outer sleeve member 312, upper cap member 313, inner sleeve member 314 and intermediate plate member 315 may be preferably fabricated from a plastic that is resistant to the typical destructive forces that a prospective shoplifter may inflict on device 310. Members 311, 312, 313, 314 and 315 may, however, be fabricated from other suitable materials in other embodiments of the present invention. In such other embodiments, different numbers of locking and connecting fingers 326 and 327 may be used to accomplish the concepts of the present invention. In still other embodiments of the present invention, the overall shapes of outer member 312 and inner member 314 may be varied without departing from the concepts of the present invention.

In use, once inner sleeve member 314 is placed on bottle neck 316 of bottle 318, top 320 of bottle 318 engages and pushes upward on end wall 324 or the user pushes upwardly on inner member 314, either action causing feet 331 to engage and slide along tapered surfaces 372 and lower angled edges 370 of outer member 312, thus causing locking fingers 326 to move inwardly toward central axis 323 so that shoulders 334 of locking fingers 326 are disposed below bead 328 of bottle neck 316 and preferably inner surfaces 332 rest against bottle neck 316. The clutch assembly engages pins 350 to retain device 310 in the locked position (FIGS. 14, 16), thus preventing inner member 314 from being moved outwardly from within cavity 365 of outer member 312. The use of device 310 is more explicitly detailed below with reference to the drawings.

The use of bottle security device 310 with bottle 318 is depicted in cross section in FIGS. 11–18. A first position for bottle security device 310 is depicted in cross section in FIG. 11 prior to inserting bottle neck 316 into inner member 314. In the first position, inner member 314 is positioned within and is initially engaging outer member 312. Pin 350 is in contact with but not held between ball bearings 442 and thus device 310 is in an unlocked position. The next position for bottle security device 310 is depicted in cross section in FIG. 12. In this position, inner member 314 has already been placed on bottle neck 316 so that shoulders 334 of locking fingers 326 are disposed below bead 328. As noted above, locking fingers 326 may be sized to engage bead 328 and be forced radially outwardly when inner sleeve member 314 is forced over bead 328. This movement is facilitated by angled or arcuate surface 330 on shoulders 334 engaging the upper surface of bead 328. Once inner member 314 is placed on neck 316, outer member 312 is moved downwardly over inner member 314. In the position depicted in FIG. 12, tapered surfaces 372 have just initially engaged feet 331 of locking fingers 326 and top 320 of bottle 318 is shown in contact with end wall 324 of inner member 314. Pin 350 and the clutch assembly remain in the unlocked position of FIG. 24 and are more clearly shown in enlarged FIG. 13.

Figure 14:
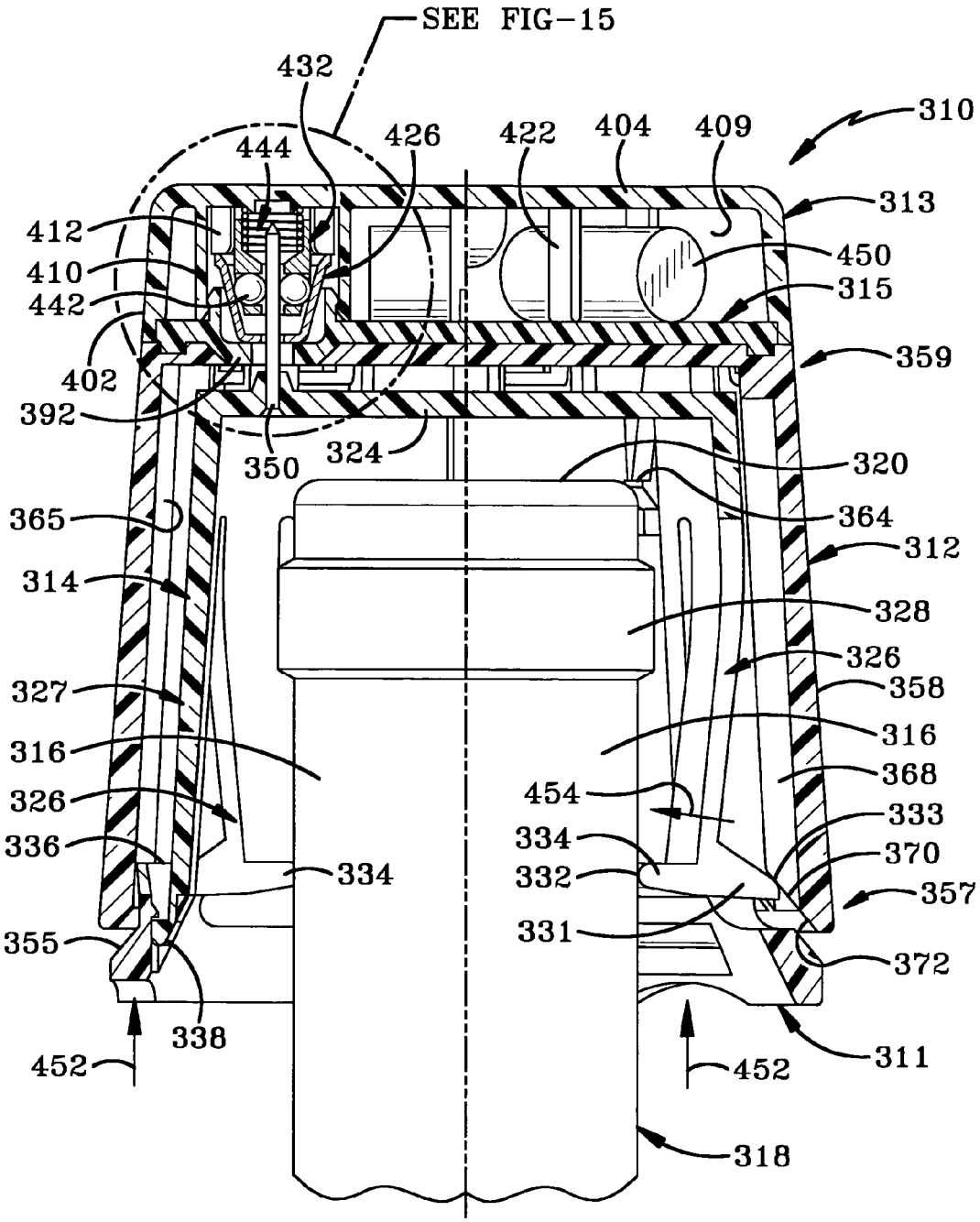
FIG. 14 is a sectional view of the bottle security device of the present invention in a locked position with the inner member moving into the outer member.
Figure 15:
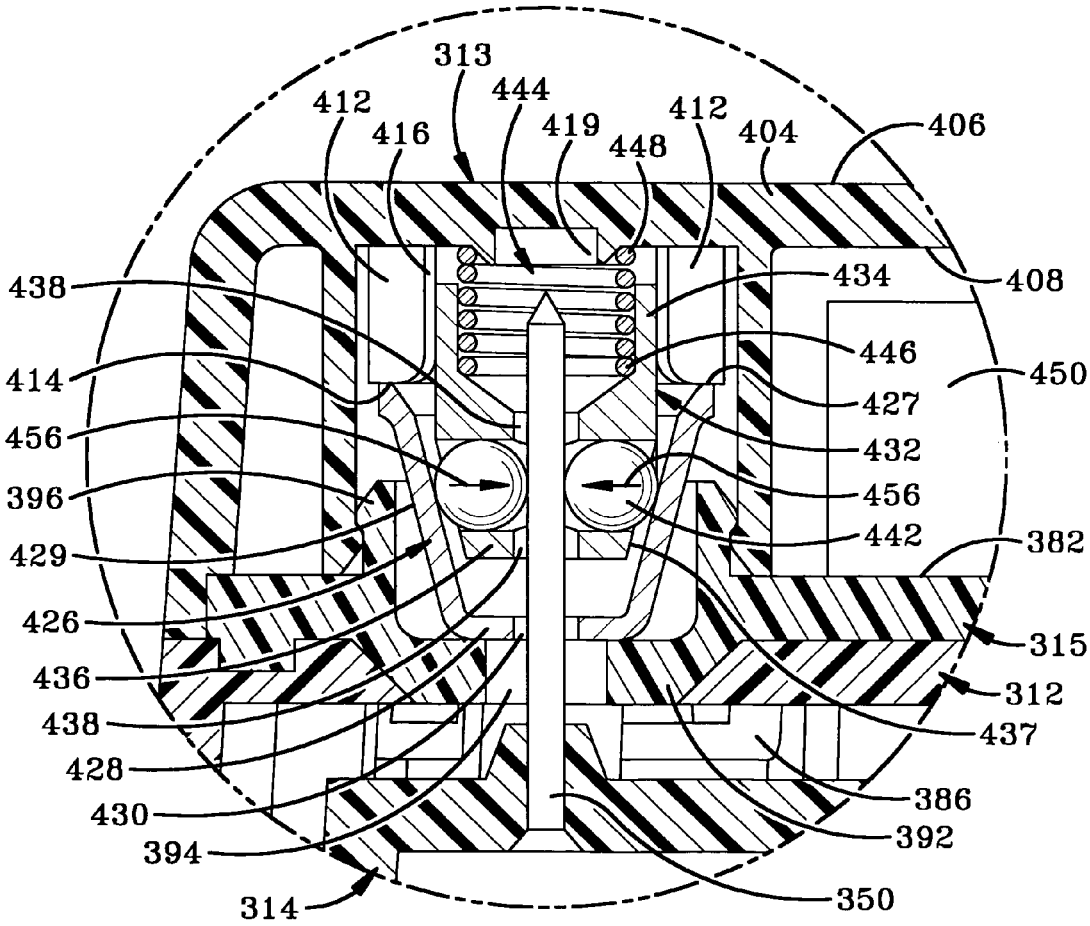
FIG. 15 is an enlarged view of the encircled portion of FIG. 14.
Figure 16:
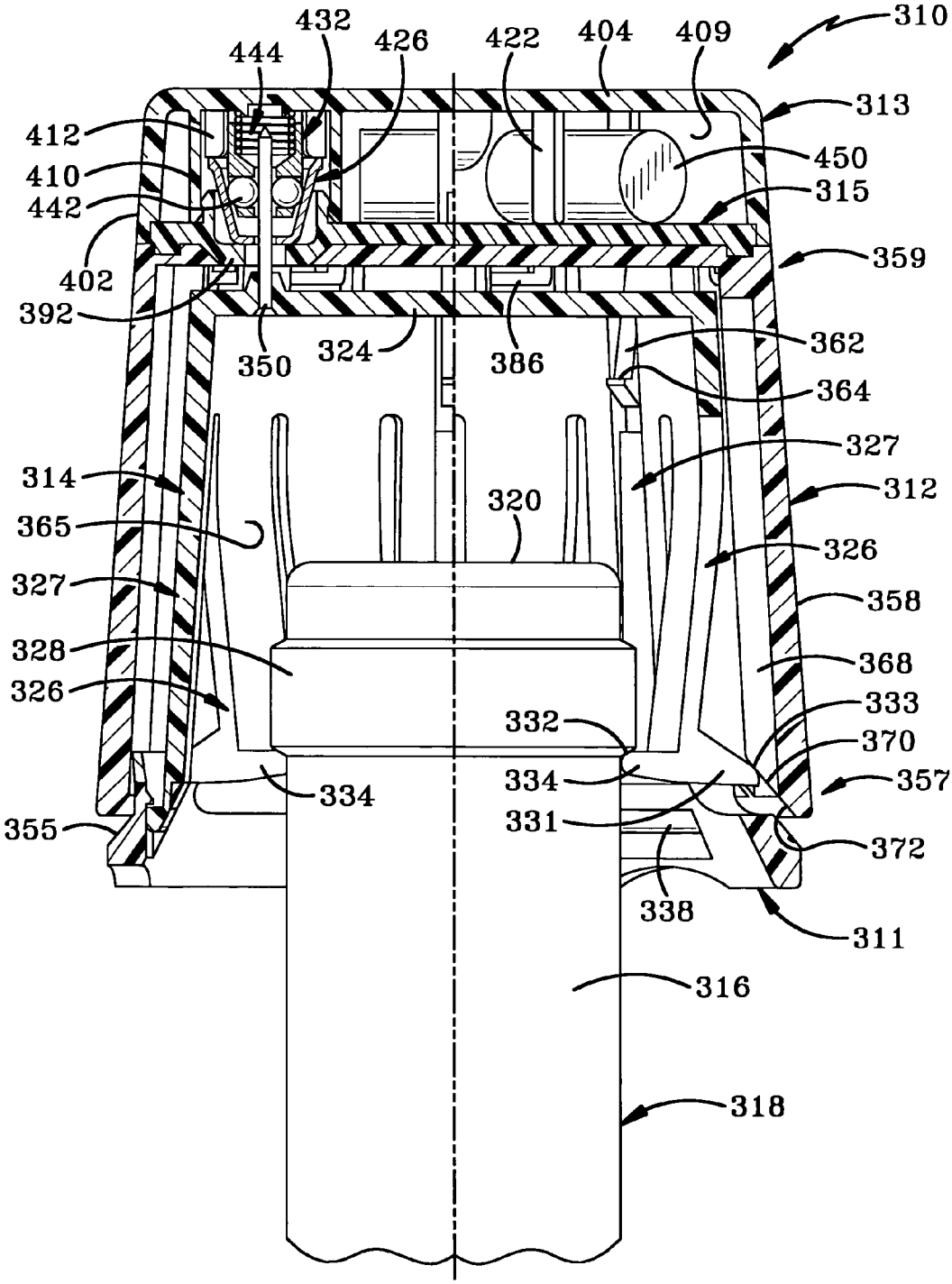
FIG. 16 is a sectional view of the bottle security device in a locked position while someone is attempting to remove the bottle from the bottle security device.

FIG. 14 depicts the next position of bottle security device 310 with inner member 314 having been moved into outer member 312 as indicated by the directional arrows labeled with numeral 452 so that tapered surfaces 372 have urged fingers 326 inwardly against neck 16 of bottle 18, as indicated by the directional arrow labeled with numeral 454. The movement of inner member 314 has also caused pin 350 to move upwardly between ball bearings 442 and inside bell 426, race 432 and spring 444 so that pin 350 is engaged by ball bearings 442, which are in turn engaged by bell 426, whereby a force is applied by ball bearings 442 inwardly on pin 350, as indicated by the directional arrows labeled with numeral 456 in FIG. 15. In this position, bottle security device 310 is locked on neck 316 of bottle 318 such that it cannot be removed by a shoplifter. An attempt to remove bottle security device 310 from bottle 318 is depicted in FIG. 16. When such an attempt is made, shoulders 334 of inner member 314 engage bead 328 of bottle 318, preventing the further upward movement of bottle security device 310 with respect to bottle 318. In addition, downward force on inner member 314 with respect to outer member 313 in turn translates into downward force on pin 350, which is held even more tightly as pin 350 thus pulls downwardly on ball bearings 442, which in turn can only apply additional inward force on pin 350 with any movement of ball bearings 442 into a narrower portion of bell 426.

As depicted in FIG. 16, shoulder 334 engages lower edge of bead 328 while the engagement of pin 350 and the clutch assembly prevent outer member 312 from moving upwardly with respect to inner member 314. In both the positions depicted in FIGS. 14 and 16, the contents of bottle 318 cannot be removed from bottle 318 without breaking bottle 318. Locking fingers 326 are configured to substantially fill the space between outer sleeve member 312 and bottle neck 316 such that a prospective shoplifter cannot easily insert a pry bar between outer member 312 and inner member 314 to potentially break bottle security device 310 away from bottle 318. Outer sleeve member 312 is also fabricated from a material that substantially resists such prying forces.

Figure 17:
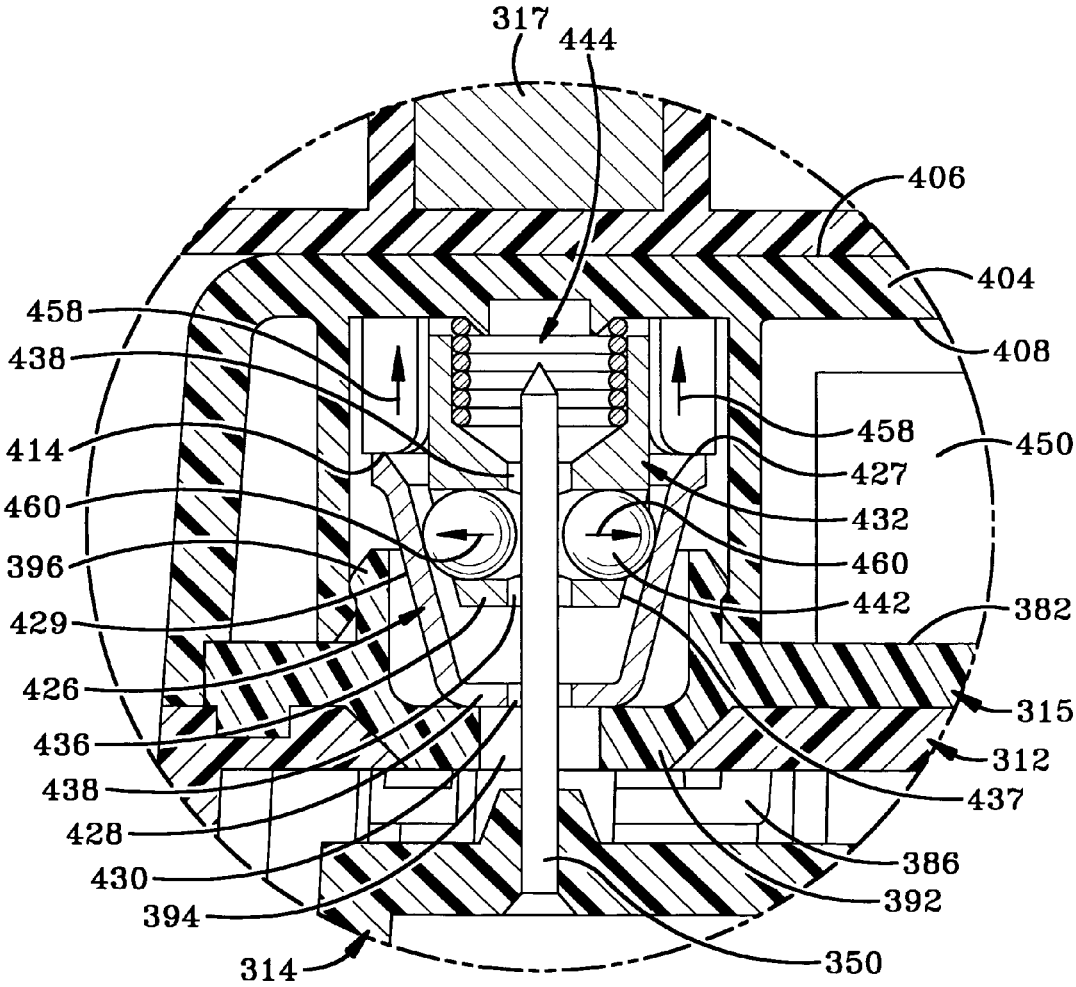
FIG. 17 is an enlarged sectional view similar to FIG. 15 but depicting the unlocking of the bottle security device by a magnetic key.
Figure 18:
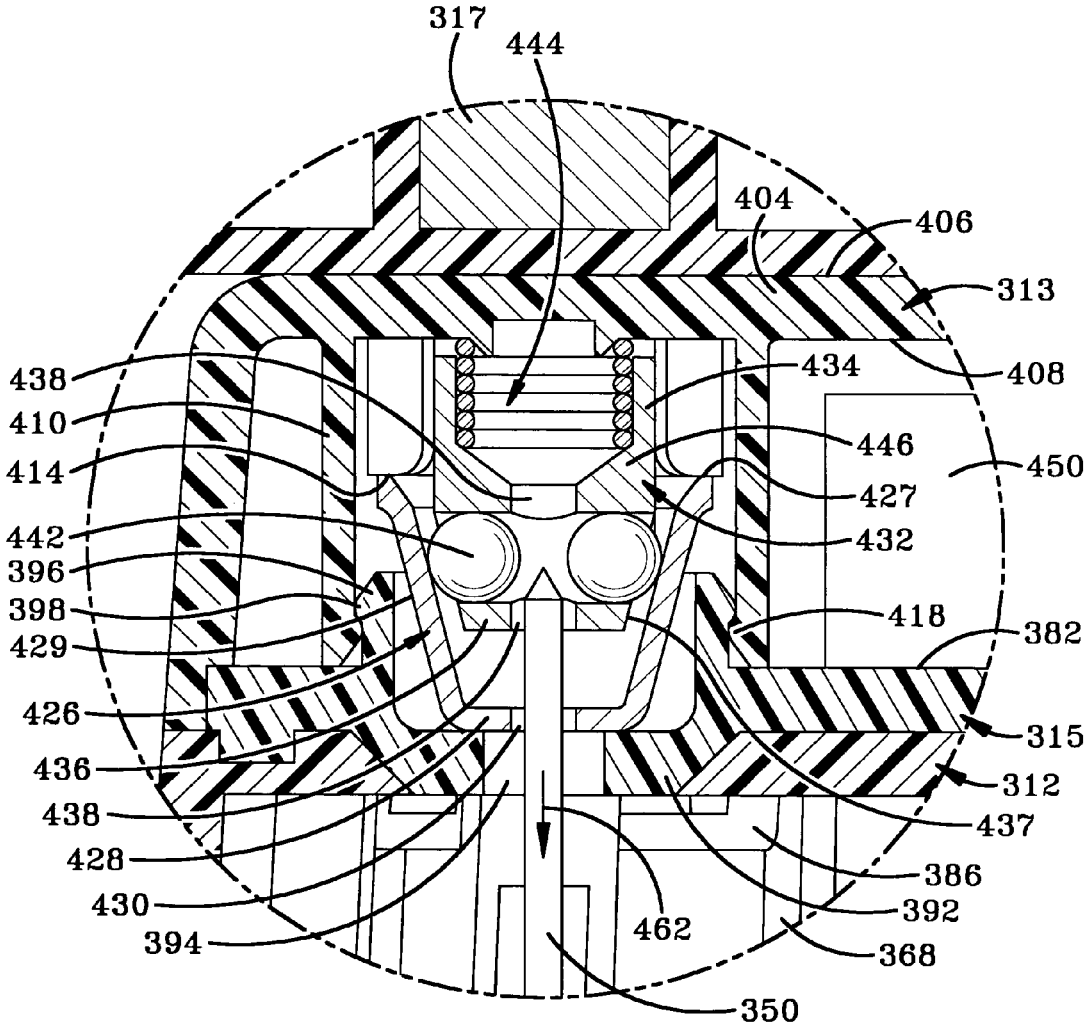
FIG. 18 is an enlarged sectional view similar to FIG. 17 additionally depicting the removal of the pin from the locking mechanism with the key maintaining the locking mechanism in an unlocked position.

Bottle security device 310 is removed from bottle 318 by utilizing key 317 as depicted in FIGS. 17 and 18. Key 317 contains magnets, and when disposed adjacent end wall 404 of cap member 313 above the clutch assembly, attracts race 432 and ball bearings 442 upwardly toward key 317, as indicated by the directional arrow labeled with numeral 458 in FIG. 17. Spring 444 is thus compressed and ball bearings 442 are free to move outwardly away from pin 350, as indicated by the directional arrow labeled with numeral 460 in FIG. 17. The frictional force holding pin 350 is thus removed and pin 350 may be moved downwardly and out of the clutch assembly, as indicated by the directional arrow labeled with numeral 462 in FIG. 18, allowing inner member 314 to move outwardly from within outer member 312 back to the unlocked position wherein locking fingers 326 have moved outwardly from bottle neck 316 to allow bottle 318 to be removed from device 310. Locking device 310 may then be reused on another suitable bottle 318. Key 317 may have alignment tabs (not shown) that align with and fit into keyholes 424 in cap member 313 to align the magnets in key 317 with the locking mechanism, thus facilitating the unlocking and removal of device 310 from bottle 318.

An (EAS) tag 450 may be disposed in various locations on bottle security device 310 such that the EAS tag 82 may not be removed from bottle security device 310 and thus bottle 318 when bottle security device 310 is in the locked position on bottle 318. Preferably, EAS tag 450 is disposed in enclosure 409, as earlier noted. Particularly, tag 450 is preferably disposed between an indentation 440 in plate member 315, indentation 420 in cap member 313 and retaining fingers 422 of cap member 313. In addition, however, EAS tag 450 may be disposed on the inwardly facing surface of end wall 360 of outer sleeve member 12. EAS tag 450 may also be disposed on the upwardly facing surface of end wall 324 of inner member 314. An alternative location for EAS tag 450 is the inwardly facing surface of end wall 324 of inner member 314. In other embodiments of the present invention, EAS tag 450 may be disposed between fingers 326 or 327 and the inwardly facing surface of sidewall 358 of outer sleeve member 312. In each of these locations, EAS tag 450 may not be removed by the prospective shoplifter when bottle security device 310 is locked on bottle 318.

Security device 310 may be configured to fit bottles 318 having different neck 316 sizes by adjusting the size of shoulders 334 and feet 331. For instance, when device 310 is to be used with a bottle having a thin neck 316, the radial length of shoulders 334 is increased. When device 310 is used with a bottle having a thick neck 316, the radial dimension of shoulders 334 is reduced. Similarly, the radial dimension of feet 331 may be adjusted. Of course, the overall size of 310 may also be varied to accommodate different size bottles 318, but adjusting shoulders 334 and feet 331 as described allows such an adjustment without changing the remaining parts of device 310.

Ring member 311 has a thickness substantial enough to help prevent a thief from accessing locking fingers 326 with a pry bar. Ring member 311 also allows the user of device 310 to manipulate inner member 314 once outer member 312 is placed over inner member 314. This allows the user to more easily push inner member 314 fully into outer member 312 to ensure full engagement of the locking mechanism.

Accordingly, the present invention of the bottle security device 310 is simplified, provides an effective, safe, inexpensive, and efficient device which achieves all of the enumerated objectives of the invention, provides for eliminating difficulties encountered with prior devices, and solves problems and obtains new results in the art.

In the foregoing description, certain terms have been used for brevity, clearness and understanding, but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact detail shown or described.

Having now described the features, discoveries and principles of the invention, the manner in which the bottle security device is constructed and used, the characteristics of the construction, and the advantageous, new and useful results obtained; the new and useful structures, devices, elements, arrangements, parts and combinations, are set forth in the appended claims.

What is claimed is:

1. A bottle security device for use with a bottle having a neck, the bottle security device comprising:

an inner member adapted to fit around at least a portion of the neck of the bottle;

an outer member having a cavity and an enclosure separate from the cavity wherein the enclosure is disposed above the inner member; a portion of the inner member disposed in the cavity and movable between locked and unlocked positions;

at least one pin connected to the inner member;

a plurality of balls which are disposed in the enclosure and are spring-biased to lockably engage the at least one pin;

wherein the outer member has an end wall and a sidewall extending downwardly therefrom; wherein a plurality of splines extend from the sidewall of the outer member into the cavity thereof and define respective inwardly and upwardly tapering surfaces; wherein the inner member includes a plurality of cantilevered locking fingers which in a locked position are adapted to secure the device to the neck of the bottle; and wherein the locking fingers engage the tapering surfaces of the splines in the locked position.

2. The device of claim 1 wherein the plurality of balls are part of a locking mechanism which is unlocked magnetically.

3. The device of claim 2 further including a key; wherein a cap member is mounted on the outer member and partially bounds the enclosure; and wherein the cap member defines at least one indentation for aligning the key with the locking mechanism to magnetically unlock them.

4. The device of claim 2 wherein the locking mechanism further includes a bell, a spring, and a race housed in the bell and housing the spring and the balls.

5. The device of claim 1 wherein at least one latch extends from the outer member into the cavity thereof for retaining at least a portion of the inner member within the cavity when the inner member is in the unlocked position.

6. The device of claim 5 wherein the outer member has an upper end and an end wall adjacent thereto; wherein the outer member has a lower end through which the inner member enters the cavity of the outer member; and wherein the at least one latch is disposed distal the lower end of the outer member.

7. The device of claim 1 wherein the outer member has a lower end and an upper end adjacent which the end wall of the outer member is disposed; and wherein the tapering surfaces of the splines are adjacent the lower end of the outer member.

8. The device of claim 7 wherein the splines extend from adjacent the upper end to adjacent the lower end of the outer member.

9. The device of claim 1 wherein each spline has upper and lower opposed ends; and wherein each spline is fixedly connected adjacent each of the upper and lower ends thereof to the sidewall of the outer member.

10. The device of claim 9 wherein the upper and lower ends of each spline defines therebetween a length; and wherein each spline is connected to the sidewall in a continuous manner along the entirety of said length.

11. A bottle security device for use with a bottle having a neck, the bottle security device comprising:

an inner member adapted to fit around at least a portion of the neck of the bottle;

an outer member having a cavity and an enclosure separate from the cavity wherein the enclosure is disposed above the inner member; a portion of the inner member disposed in the cavity and movable between locked and unlocked positions;

at least one pin connected to the inner member;

a plurality of balls which are disposed in the enclosure and are spring-biased to lockably engage the at least one pin; and wherein the device is free of a spring mechanism disposed above the inner member for moving the inner member in a direction away from the enclosure.

12. The device of claim 11 wherein the plurality of balls are part of a locking mechanism which is completely out of view when the device is locked on the neck of the bottle.

13. The device of claim 12 wherein the locking mechanism is completely disposed within the enclosure.

14. The device of claim 11 wherein the at least one pin includes two pins; wherein there are a pair of locking mechanisms each disposed in the enclosure and each including a plurality of balls which are spring-biased to respectively lockably engage the two pins.

15. The device of claim 14 wherein each locking mechanism which is unlocked magnetically.

16. The device of claim 15 wherein each of the locking mechanisms must be in an unlocked position simultaneously to unlock the bottle security device.

17. The device of claim 16 wherein the two locking mechanisms are unlocked by a single key.

18. A bottle security device for use with a bottle having a neck, the bottle security device comprising:

an inner member adapted to fit around at least a portion of the neck of the bottle;

an outer member having an end wall and a sidewall extending downwardly therefrom to define a cavity below the end wall; a portion of the inner member disposed in the cavity and movable between locked and unlocked positions;

an enclosure disposed above the end wall and separate from the cavity;

a plurality of splines extending from the sidewall of the outer member into the cavity wherein the splines are free of a locking engagement with the inner member;

at least one pin connected to the inner member; and at least one locking mechanism at least partially disposed in the enclosure and adapted to lockably receive the pin.

19. The device of claim 18 wherein each spline has upper and lower opposed ends; and wherein each spline is fixedly connected adjacent each of the upper and lower ends thereof to the sidewall of the outer member.

20. The device of claim 19 wherein the upper and lower ends of each spline defines therebetween a length; and wherein each spline is connected to the sidewall in a continuous manner along the entirety of said length.

* * * * *